United States Patent [19]

Kadan et al.

[11] 4,222,349

[45] Sep. 16, 1980

[54] STACK EXHAUST HEAT RECYCLING SYSTEM

[76] Inventors: Bertram Z. Kadan; Seymour Kadan; Alvin Kadan, all of P.O. Box 234, Greenfield Park, N.Y. 12435

[21] Appl. No.: 899,450

[22] Filed: Apr. 24, 1978

[51] Int. Cl.[3] ..... F22B 33/00

[52] U.S. Cl. ..... 122/20 B; 122/421

[58] Field of Search ..... 122/20 B, 412, 421; 165/DIG. 2; 126/350 R

[56] References Cited

U.S. PATENT DOCUMENTS

| | | | |
|---|---|---|---|
| 1,665,210 | 4/1928 | Johnson | 122/20 |
| 1,953,302 | 4/1934 | Johnston | 122/20 |
| 1,990,056 | 2/1935 | Van Daam | 122/20 |
| 2,160,678 | 5/1939 | Ruby | 122/20 |
| 3,507,256 | 4/1970 | Sander | 122/20 |
| 3,793,992 | 2/1974 | Marquez | 122/20 |
| 4,037,567 | 6/1977 | Torres | 122/20 |

*Primary Examiner*—Edward G. Favors

*Attorney, Agent, or Firm*—Wolder, Gross & Yavner

[57] ABSTRACT

A stack exhaust heat recycling system utilizing the heat content of exhaust gases passing through a smoke stack to the ambient atmosphere. The stack includes an inner shell defining a passage to carry the exhaust gases without restrictive draft. Surrounding this shell in any desired configuration is tubing carrying fluids (liquids, gas or oils). Surrounding the tubing is an intermediate shell, insulation and an outer shell. During the passage of the fluid through the tubing, transfer of heat occurs from the gases to the fluid so that its temperature is elevated for use, e.g., as hot water, thus eliminating or supplementing a hot water heater. Other uses requiring elevation of the temperature of water or gas may be similarly utilized.

7 Claims, 6 Drawing Figures

FIG. 1
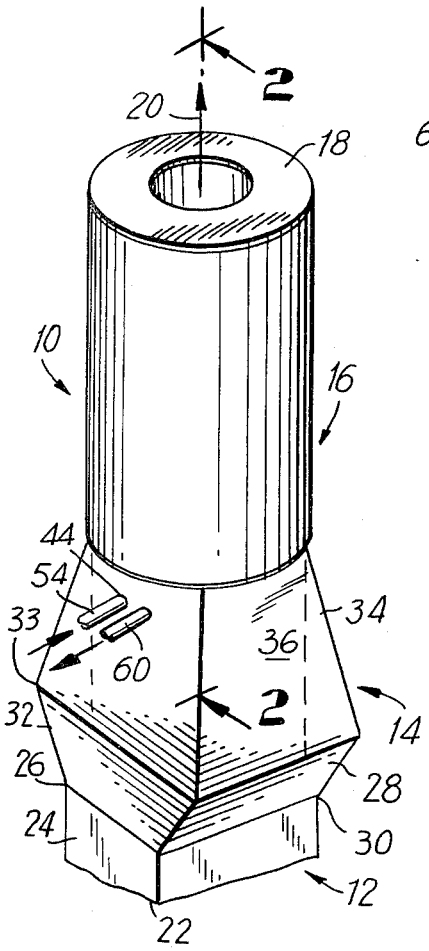
FIG. 2
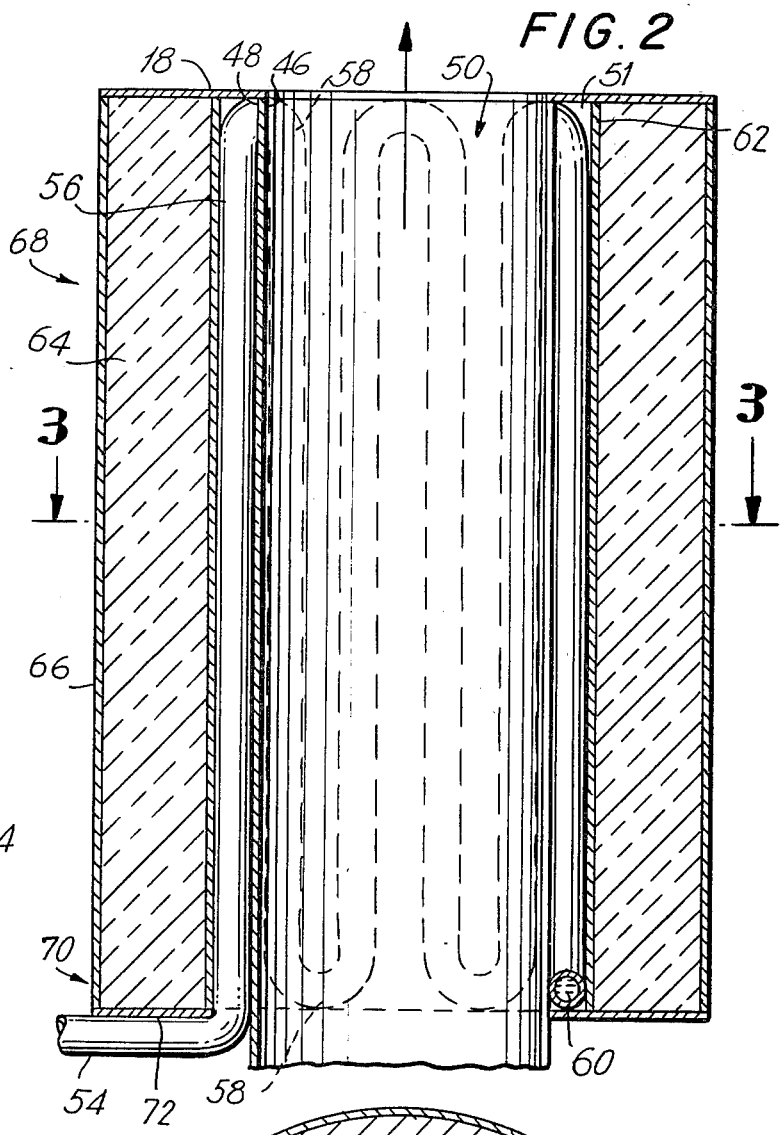
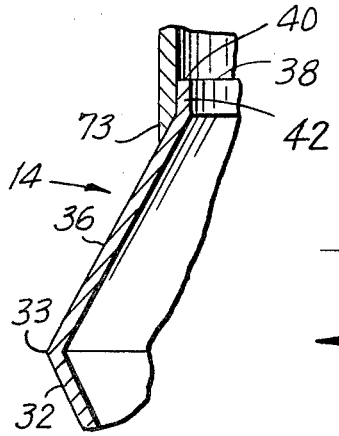
FIG. 1A
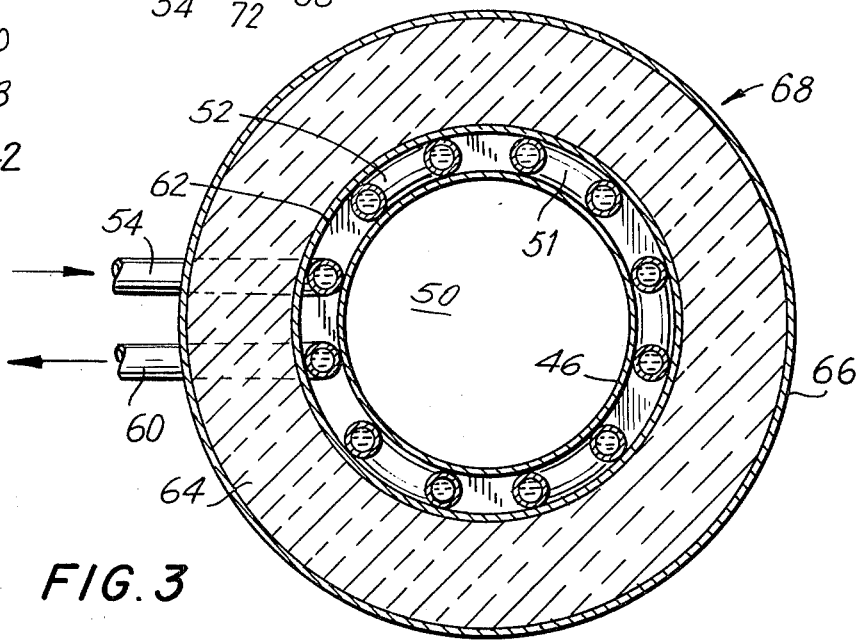
FIG. 3

STACK EXHAUST HEAT RECYCLING SYSTEM

BACKGROUND OF THE INVENTION

This invention relates generally to a stack exhaust heat recycling system and more specifically, a system of utilizing exhaust gases passing up, for example, through smoke stacks by transferring the heat in such gases to raise or elevate the temperature of fluids.

In the past, fuels have been combusted in furnaces, and the exhaust gases have been conducted to the ambient atmosphere through passages such as smoke stacks. The exhaust gases tend to be of a very high temperature, and this heat is passed into the ambient atmosphere. The heat generated by the furnace which is utilized, generally heats such things as water, to produce steam for steam plants or to drive electrical turbines in an electrical power generating plant. Other examples of usage are the heating of water in a hot water system, or to utilize the heat for heat sinks or heat pumps for air conditioners or heat pump systems. In all such situations, fuel is required to separably heat the fluid whose temperature is desired to be elevated. Such use of fuel results in low efficiency in that only part of the heat generated by combustion is utilized to heat the fluid. The remainder of the heat is dispersed into the atmosphere by the exhaust gases and lost as a waste product.

SUMMARY OF THE INVENTION

Accordingly, among the principal objects of the present invention is to provide a improved means of recycling heat from a stack exhaust system which will greatly increase the efficiency of the heat captured which would otherwise be lost in the atmosphere based upon the amount of BTU generated proportionally to the amount of fuel consumed per hour.

Still yet another object of the present invention is to provide means to allow transfer of heat from the exhaust gases to adjacent fluids, thus elevating the temperature of the fluids prior to introduction into the main heat receiving or temperature elevating location.

Still yet a further object of the present invention is to provide a heat recycling system which will result in a substantial increase in efficiency and out put of BTU per fuel consumption.

Still yet another object of the present invention is to provide a recycling system resulting in a series of passages containing fluids in continuous and adjacent relationship to the exhaust gases, allowing transfer of heat from the exhaust gases to the passages so that the temperature of the fluids will be elevated from the time of introduction to the time of exit from the system.

Still yet another object of the present system is to provide a heat recycling system which may be readily used in diverse operations as chemical plants, electrical generating stations, steam generating stations, and industrial air conditioning and heat pump systems without the addition of expensive and complex equipment. Still yet another object of the present invention is to provide a system which may rapidly and simply be utilized for small systems, such as hot water heaters, or central air conditioning units for small units such as homes, as well as heat pump systems, without the installation of expensive and extensive supplementary units.

Still yet another object of the present invention is to provide a stack exhaust heat recycling system which will not only increase the efficiency based upon fuel consumption, but will result in energy conservation and reduction in pollutants emitted into the atmosphere, as well as cooling the stack.

In accordance with the terms of the present invention, there is provided a stack exhaust heat recycling system which generally consists of a existing stack base with a collar positioned on the top. Then, positioned on top of the collar is a stack construction in accordance with the terms of the present invention. Basically the construction consists of an inner shell defining a passageway for the exhaust gases. Adjacent the inner shell is tubing which may extend either horizontally in coils or vertically in rows, but in any event, in such a manner as to cause a significant continuous exposure through the shell. The tubing has an inlet which is positioned in the collar and an outlet, also positioned in the collar. The tubing is surrounded by an intermediate shell, and then insulation and then an outer shell. The purpose of the insulation is to prevent heat from escaping to the ambient atmosphere, while allowing the most substantial portion of heat transfer to occur from the exhaust gases into the space defined between the intermediate shells containing the tubing. Thus heat is transferred from the exhaust gases to the fluid carried by the tubing. This tubing may be connected to the municipal water inlet line for example and by the time the water passes from the outlet, its temperature has been sufficiently elevated so that when it is introduced for example, to a boiler which receives the primary heat from the furnace to which the stack is connected, much less heat is required from the boiler to turn the water into steam. Another example would be the use of a small unit in a house having a furnace in which the tubing coiled around the exhaust stack would be sufficient to elevate the temperature of water, thus generally eliminating the need for a separate hot water heater, or substantially reducing the amount of fuel needed to heat such water.

BRIEF DESCRIPTION OF THE DRAWINGS

FIG. 1 is a front perspective view illustrating the positioning of the stack embodying the invention, together with a collar on top of an existing stack from a furnace.

FIG. 1A is a detail showing the fitting of the collar to the stack embodying the invention.

FIG. 2 is a side cross-sectional view taken along the lines 2—2 of FIG. 1, but with a modification of the collar and support.

FIG. 3 is a cross-sectional view taken along the lines 3—3 of FIG. 2.

DETAILED DESCRIPTION OF THE PREFERRED EMBODIMENTS

Figure 4:
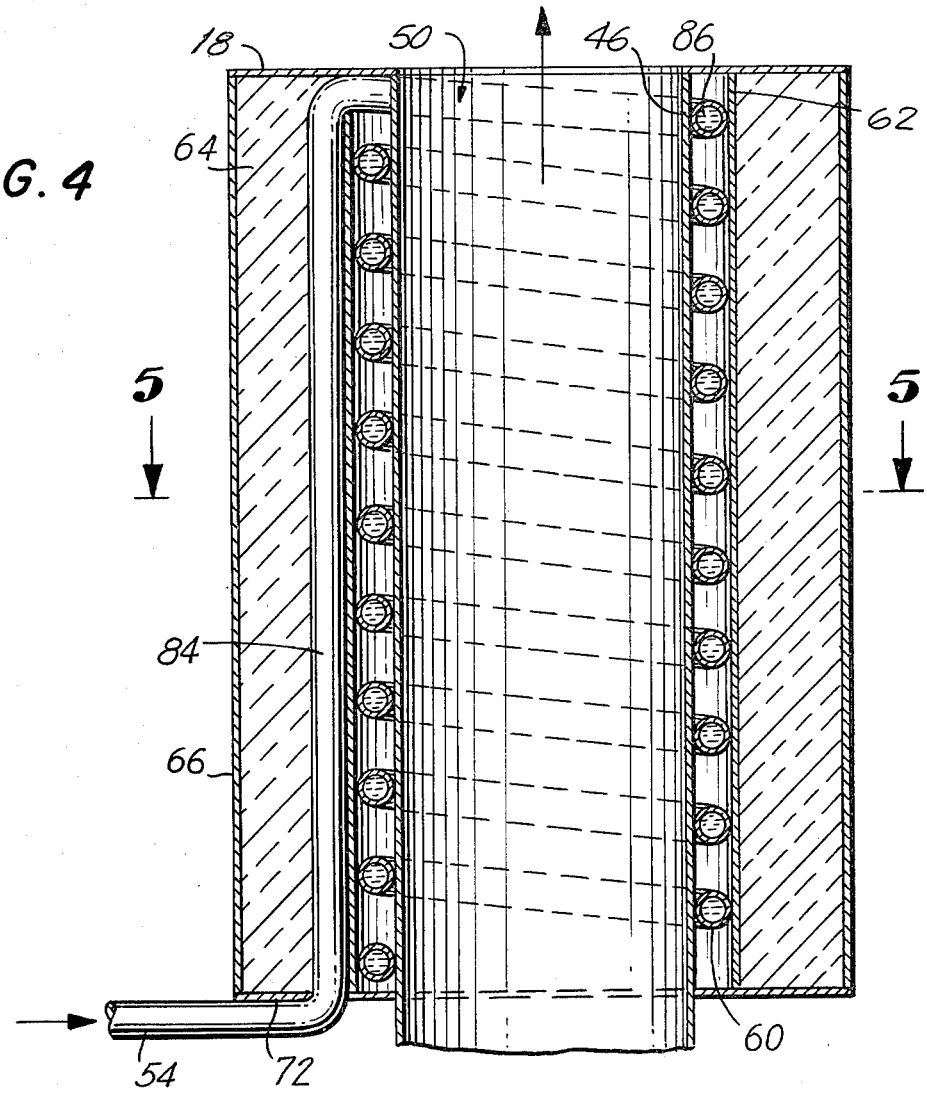
FIG. 4 is a cross sectional view, similar to that of FIG. 2, but showing the tubing in a different configuration surrounding the inner shell.

Turning in detail to the drawings and more particularly to FIG. 1, there is shown a stack exhaust heat recycling system 10 embodying the present invention and broadly comprising an existing base stack 12 upon which is mounted a collar 14 on top of which is secured a stack 16 with a standard cap 18 on the top. The exiting exhaust gases are indicated by the arrow 20.

The base stack 12 has a lower bottom or base 22 which rests on the top of the furnace and above the fire.

Depending upwardly from the base 22 are side walls 24 terminating in a top wall 26.

Positioned on top of the stack 12 is a collar 14 having a lower portion which in appearance is a reverse truncated pyramid shaped member 28 defined by a base 30 resting on the top of the top wall 26 of the stack 12, side walls 32, and terminating in its outwardly direction at edge 33. Positioned thereupon is an upright truncated pyramid shaped member 34 defined by side walls 36 and terminated by a top wall 38 (FIG. 1A) The top wall has an upper rim 40 from which depends an upstanding ring 42 for the purpose hereinafter appearing. In addition, there are openings 44, also for the purpose hereinafter appearing. It is understood that any well known configuration may be adopted for the collar without departing from the invention.

The stack 16 is defined by an inner shell 46 (FIG. 2) for defining a passage 50 which, in an illustrated embodiment, is generally cyclindrical in shape. It is standard to have chimney passages which are cylindrical or they may be rectangular. The particular shape and design of the passage and the shells does not form a part of the present invention. The material used for the inner shell is not of critical importance, other than it must be capable of transferring heat with a low resistance. Such materials are well known in the art and are composed of any desired metalic alloy or general metal or synthetic as is currently used. An example is galvanized sheet metal or black stove pipe.

Adjacent to the outer wall 48 of the shell 46 are compartments containing a tubing 52. The tubing forms an essential part of the invention and is defined by an inlet portion 54. The general tubing which is shown in FIG. 2 extends in the vertical direction forming a vertical member 56 coupled together by U-members 58, the U-members being both at the top and the bottom of the stack. The final vertical drop terminates in an outlet 60. The tubing is manufactured of a material which can easily carry fluids, such as gases, oils and liquids, traversing the entire vertical height and around the horizontal dimensions of the stack withstanding the high temperatures from the exhaust gases, and yet being capable of absorbing the heat from the exhaust gas which pass into the fluids contained therein. Such examples of acceptable piping are well known alloys, metals and synthetic materials. An example is copper tubing. As a general rule, the pressure at the heat of water obtained from the local municipality or any standard pump is sufficient to drive the water to the required vertical height.

Depending upon the particular installation and the required performance, the tubing may be designed as a complete system from both its lower to upper extremities or can be joined together in stages such as by sweating, welding, brasing or by deep-seated compression coupling, steam fitting (etc).

Positioned on the other side of the tubing from the inner shell 46 is an intermediate shell 62. This shell is designed to protect the tubing and to assist in preventing the passage of the heat transferred from the gases to the tubing from passing further outwardly beyond the tubing. Thus this intermediate shell may be made from a material which has good insulating properties. An example of such a material is reflective coated metal.

On the other side of the intermediate shell and outwardly from the tubing is insulation 64, also desired to retain the heat from passing beyond the tubing. In order to protect the insulation, the stack on its outer portion is defined by an outer shell 66 which may also be made of material which has good insulating qualities as well as qualities to protect the stack from environmental conditions. Examples are asbestos, fiber glass.

On the top of the outer shell 66, insulation 64, intermediate shell 62, and above the tubing 52 and the inner shell 46 is the cap 18. Such a cap is standard and well known in the smoke stack technology. Also positioned over the center passage 50 is a spark arrestor (not shown) which is also well known in the industry.

Depending down from the top portion 68 of the stack towards the bottom portion 70, there is shown one form of a bottom portion in FIG. 2 having a bottom edge 72 supported above the piping. Another probably more preferrable form is shown in FIG. 1A in which the stack has a knife-edge 73 and it is designed so that the stack fits right inside the ring 42 and rests on the upper portion of the walls 36 of the collar 14.

Figure 5:
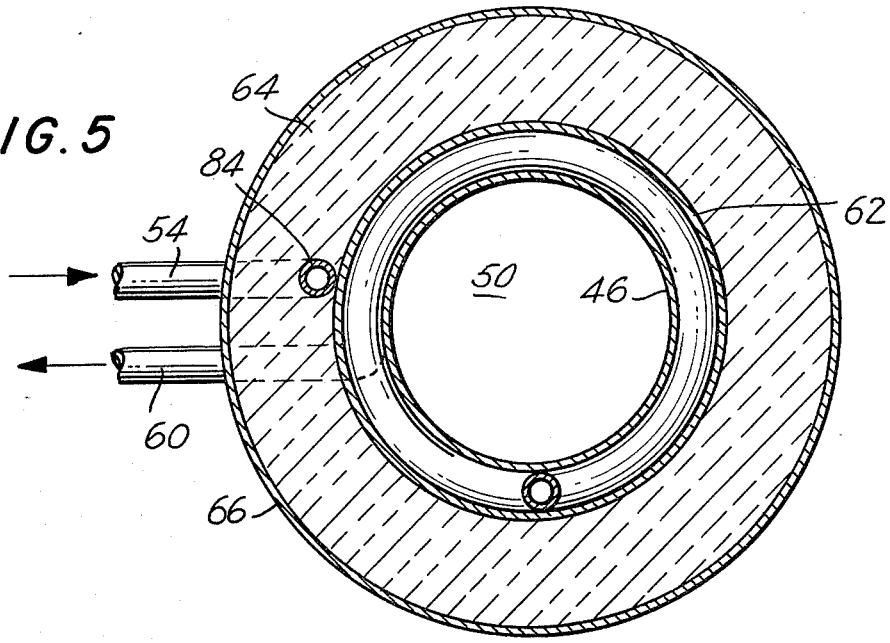
FIG. 5 is a cross-sectional view taken along the lines 5—5 of FIG. 4.

Turning to FIGS. 4 and 5, there is shown an alternative embodiment of the stack in which fluid from the inlet 54 is carried up to the very top of the stack and then, instead of there being a series of vertical turns being connected by U-shaped members, the tubing circles around the stack in a series of coils, until it reaches the bottom of the stack and the outlet. In this embodiment the vertical member 84 passes upwardly through the insulating material to the top of the stack where it thence turns in a horizontal direction and merges into the coiled tubing 86 which continues coiling around the stack until it reaches the outlet 60.

It is understood that numerous other design configurations of the tubing surrounding the stack may be utilized. An example would be to reverse the coils and introduce the fluid at the bottom of the stack.

Thus, the system is constructed utilizing the continuous tubular network from inlet to outlet and permits the insertion of appropriate safety devices such as the emergency blow-off vales, check valves, etc. where necessary. The capacity and dimensions along with other pertinent data are determined primarily by the size of the system required. The efficiency is determined by the overall size of the system utilized. It is obvious that placing the tubing on the outer surface 48 of the inner shield 46 is done to prevent the build-up of carbon deposits on the tubing and thus eliminates the source of loss of efficiency in heat transfer.

While there has been described and illustrated preferred embodiments of the present invention, it is apparent that numerous alterations, omissions and additions may be made without departing from the spirit thereof.

We claim:

1. A stack exhaust heat recycling system utilizing the heat present in exhaust gases to heat a fluid which comprises an exhaust passage defined by a first shell; an intermediate shell encircling said first shell defining a space therebetween;

tubing means positioned within the space to circulate the fluid proximate the first shell; and insulation means proximate the tubing means but on the other side of the intermediate shell whereby heat is transferred from the exhaust gases into the circulation means but is substantially retained by the said means, whereby fluids may be elevated in temperature prior to the introduction to a desired position within a system.

2. The invention according to claim 1, the tubing passing upwardly in a vertical direction along the length of the shell and then being disposed downwardly in a vertical direction, parallel to the first portion, the final vertical member being connected to the outlet.

3. The invention according to claim 1, the tubing including a vertical member passing upwardly to the top of the shell, and thence forming a series of coils, passing around the shell and ultimately terminating at the outlet at the bottom of the shell.

4. The invention according to claim 1, the first shell being a smoke stack, a collar positioned beneath and supporting said stack.

5. The invention according to claim 4, the upper edge of the collar including an upstanding rim received within the stack, the collar further containing means for accommodating inlet and outlet portions of the circulation means.

6. The invention according to claim 2, the first shell being a smoke stack, a collar positioned beneath and supporting said stack.

7. The invention according to claim 3, the first shell being a smoke stack, a collar positioned beneath and supporting said stack.

* * * * *